United States Patent [19]

Rossmann et al.

[11] Patent Number: 4,485,027

[45] Date of Patent: Nov. 27, 1984

[54] CLEANING COMPOSITIONS CONTAINING BORIC ACID OR AN ALKALI METAL BORATE IN PHOSPHORIC ACID AND THEIR USE IN CLEANING SOLID SURFACES

[75] Inventors: Christian Rossmann, Langenfeld; Helga Bürger, Erkrath, both of Fed. Rep. of Germany

[73] Assignee: Henkel Kommanditgesellschaft auf Aktien, Dusseldorf, Fed. Rep. of Germany

[21] Appl. No.: 537,591

[22] Filed: Sep. 30, 1983

[30] Foreign Application Priority Data

Dec. 13, 1982 [DE] Fed. Rep. of Germany ..... 3246124

[51] Int. Cl.[3] ..... C11D 7/06; C11D 7/08; C11D 11/04; C11D 17/00

[52] U.S. Cl. ..... 252/90; 134/27; 134/28; 134/29; 134/40; 252/135; 252/136; 252/142; 252/156; 252/524; 252/527; 252/540; 252/DIG. 1

[58] Field of Search ..... 252/135, 136, 90, 91, 252/92, 93

[56] References Cited

U.S. PATENT DOCUMENTS

| | | | |
|---|---|---|---|
| 1,609,847 | 12/1926 | Vickery | 252/135 |
| 1,870,312 | 8/1932 | Gangloff | 252/135 |
| 2,444,836 | 7/1948 | MacMahon | 252/135 |
| 3,494,868 | 2/1970 | Gray | 252/99 |
| 3,527,608 | 9/1970 | Schluessler | 134/2 |
| 3,586,633 | 6/1971 | Schlussler | 252/137 |
| 3,687,858 | 8/1972 | Geisler | 252/156 |
| 3,840,481 | 10/1974 | Miller | 252/546 |
| 3,927,970 | 12/1975 | Ciko | 8/137 |
| 4,000,083 | 12/1976 | Heesen | 252/135 |
| 4,286,956 | 9/1981 | Bechstedt | 8/137 |

FOREIGN PATENT DOCUMENTS 1302882 1/1971 Fed. Rep. of Germany .

OTHER PUBLICATIONS

Ullmanns Encyklopaedie der technischen Chemie, vol. 20, 4th ed., "Reinigungsmittel", by Dr. Hans Wedell and Dr. Hans-Joachim Schluessler, pp. 147, 154–155.

*Primary Examiner*—Dennis L. Albrecht

*Attorney, Agent, or Firm*—Ernest G. Szoke; Nelson Littell, Jr.

[57] ABSTRACT

This invention is directed to a process for cleaning solid surfaces with aqueous alkaline cleaning compositions comprising (a) strongly alkaline active-substance concentrates and (b) acidic active-substance concentrates comprising dispersions of boric acid or alkali metal borates in orthophosphoric acid. Component (a) is present in an excess over component (b) sufficient to cause an alkaline medium.

9 Claims, No Drawings

CLEANING COMPOSITIONS CONTAINING BORIC ACID OR AN ALKALI METAL BORATE IN PHOSPHORIC ACID AND THEIR USE IN CLEANING SOLID SURFACES

FIELD OF THE INVENTION

This invention relates to compositions for cleaning solid surfaces. More particularly, this invention relates to builder-containing alkaline solutions comprising strongly alkaline active-substance concentrate and an acidic active-substance concentrate consisting of boric acid or an alkali metal borate in phosphoric acid.

BACKGROUND OF THE INVENTION

It is known that polyphosphate-based products are used for cleaning solid material in single-chamber spraying machines on account of the transparent film remaining behind on the workpieces and that phosphate/alkali metal borate-based products are used for cleaning workpieces of aluminum and its alloys. These cleaning products are generally marketed as powered mixtures and are delivered as such to a cleaning bath at intervals, the concentration of cleaning agent in the bath amounting to from about 0.1 to 20% by weight, dependent upon the particular application and the degree of soiling. If the cleaning solution is to be effective, the optimal concentration must be maintained. The optimal concentration may be determined by titration or by a conductivity measurement. The conductivity measurement for determining concentration may be carried out in conjunction with an automatic concentration adjustment.

One of the difficulties of using powdered products, particularly when they contain hydroscopic salts, is to ensure continuous uninterrupted introduction. In addition, it is precisely highly active, nonionic surfactants which are sensitive to solid caustic soda. During storage they change through oxidation to ether carboxylic acids, which impairs effectiveness with respect to certain greases and, in the case of degreasing sprays, causes troublesome foaming.

It is also known that liquid cleaning agents showing an alkaline reaction can be used for the purpose in question, having been obtained and regenerated by combining a strongly alkaline active-substance concentrate with a acidic active-substance concentrate. However, it has not been possible in this way, due to the poor solubility of boric acid and the inadequate stabililty of polyphosphoric acid, to produce products based on those acids. The use of agents containing orthophosphoric acid leads to a troublesome, white coating on the metal surfaces in the case of single-stage cleaning. Solutions of the type in question also effect aluminum.

Furthermore, it has also proven difficult to use highly concentrated active-substance components without an unnecessary concentration of hydrotropic substances and/or of potassium salts having a low active-substance content being required.

OBJECTS OF THE INVENTION

It is an object of the invention to provide compositions for cleaning solid surfaces.

It is also an object of the invention to provide builder-containing alkaline solutions comprising strongly alkaline active-substance concentrate and an acidic active-substance concentrate consisting of boric acid or alkali metal borate in orthophosphoric acid.

These and other objects of the invention will become more apparent in the discussion below.

DETAILED DESCRIPTION OF THE INVENTION

It has now been found that most of the disadvantages encountered hitherto can be avoided by using the process described hereinafter. According to the process, solid surfaces are cleaned with builder-containing alkaline solutions obtained by combining a strongly alkaline active-substance concentrate with an acidic active-substance concentrate, the alkaline active-substance being used in excess to obtain an alkaline medium, the solution being characterized in that a dispersion of boric acid or alkali metal borates in orthophosphoric acid in a ratio by weight of from 1:4 to 1:20 is used as the acidic active-substance concentrate. The concentration of boric acid or alkali metal borates in the dispersion should be in the range of from about 5 to 30% by weight, preferably from about 5 to 20% by weight, based upon the total weight of the acidic active-substance concentrate. Instead of boric acid, it is also possible to use alkali metal borates such as $NaBO_2$ and, in particular, borax ($Na_2B_4O_7$ with 5 or $10H_2O$). Some of the orthophosphoric acid, i.e., up to about 50%, may also be replaced by sulfuric acid.

Additions of anionic, nonionic and/or amphoteric surfactants are suitable for obtaining a good cleaning effect. To this end, it is possible to use such compounds as alkyl benzene sulfonates, alkyl sulfonates, fatty alcohol sulfates, adducts of ethylene and/or propylene oxide onto fatty alcohols, fatty amines, or alkyl phenols, and also surface-active ethylene oxide/propylene oxide block polymers. The carbon chain lengths of the alkyl radicals in these compounds are in the range from 12 to 20, with the exception of the alkyl phenols where the carbon chain lengths are in the range of from about 6 to 18. Other suitable amphoteric surfactants include such compounds as alkyl dimethylammonium betaines ($C_{12}$–$C_{18}$-alkyl radical). The quantities of wetting agents advantageously amount to from about 0.5 to 10% by weight, based upon the total weight of the acidic active-substance concentrate.

In addition, the boric acid dispersion advantageously contains other constituents, particularly complexing agents, such as nitrilotriacetic acid, ethylenediaminetetraacetic acid, gluconic acid, and/or citric acid, preferably phosphonic acids or phosphonocarboxylic acids, such as 1-hydroxyethane-1,1-diphosphonic acid, aminotrimethylene phosphonic acid, and 2-phosphone-1,2,4-butane tricarboxylic acid. The complexing agents may be added in a quantity of up to about 5% by weight, based upon the total weight of the cleaning agent.

Optionally, the complexing agents may also be added to the alkaline component. The alkaline component consists essentially of sodium hydroxide or potassium hydroxide.

In the context of the invention, the expression "excess" is to be understood to mean a quantity of sodium hydroxide or potassium hydroxide which is sufficient to give the active-substance concentrate after combination a pH-value above 8, preferably in the range of from 9 to 12.

The dispersions may be prepared by introducing boric acid or alkali metal borates in appropriate quantities with stirring into orthophosphoric acid heated to approximately 70° C. Surfactants and complexing agents are similarly introduced.

The procedure described above has the advantage that highly concentrated active-substance components can be produced without an unnecessary concentration of hydrotropic substances and/or potassium salts having a low active-substance content being required.

In the preparation of cleaning agent solutions using two active-substances components, it is possible to make up a cleaning solution differing in its alkalinity according to the degree of soiling of the material to be treated by using a large or relatively small proportion of the alkaline component. Since the cleaning solution always shows an alkaline reaction, the concentration of the solution may be determined through the conductivity of the hydroxyl ions. The other active-substance components are then added in a ratio commensurate to the alkaline component. This ensures continuous, problem-free introduction of the cleaning agent concentrates. To make the concentrates more visible, they may be colored with indicators. As for the other conditions, the process is carried out at the temperatures normally used for cleaning and degreasing, i.e., at temperatures in the range of from about 20° to 100° C., preferably at temperatures in the range of from about 50° to 80° C.

The following examples are intended to illustrate the invention and should not be construed as limiting the invention thereto. The percentages mentioned below are percentages by weight.

EXAMPLES

EXAMPLE 1

Steel sheets were degreased in a degreasing bath consisting of 50% sodium hydroxide solution and a dispersion of boric acid in $H_3PO_4$ mixed in a ratio by weight of 3:2. The dispersion contained 9% of boric acid, 87% of orthophosphoric acid, and 4% of a nonionic wetting agent (adduct of 4 mols of ethylene oxide and 5 mols of propylene oxide onto fatty alcohol). A standard 20 gm/l treatment solution having a pH-value of 11.5 thus consisted of 20 gm/l of dispersion and 30 gm/l of 50% sodium hydroxide. The temperature of the treatment bath was 75° C. The steel sheets treated therein were satisfactorily degreased. The cleaning agent dried leaving a transparent film.

EXAMPLE 2

Aluminum workpieces were degreased in a solution having a pH-value of 9.2 and containing 60 gm/l of 50% sodium hydroxide and 50 gm/l of the following dispersion:

18.0% of boric acid,
77.5% of orthophosphoric acid (85%),
0.5% of alkylbenzenesulfonic acid ($C_{12}$-alkyl radical),
2.0% of the adduct of 11 mols of ethylene oxide onto nonyl phenol, and
2.0% of 1-hydroxyethane-1,1-diphosphonic acid (50%).

EXAMPLE 3

The preparation of a cleaning solution having a pH of 11.5 required 75 gm/l of 50% sodium hydroxide solution and 50 gm/l of the following dispersion:

12.0% of boric acid,
85.0% of orthophosphoric acid (85%), and
3.0% of amphoteric wetting agent (alkyl dimethyl ammonium betaine, $C_{12}$–$C_{18}$-alkyl radical).

EXAMPLE 4

A dispersion with the following composition was prepared:

72.0% of orthophosphoric acid (85%),
10.0% of sulfuric acid (98%),
9.0% of boric acid,
9.0% of the adduct of 9.5 mols of the ethylene oxide onto nonyl phenol.

Twenty grams per liter of dispersion required 25.5 gm/l of 50% sodium hydroxide for a cleaning solution having a pH-value of 9.2 for degreasing aluminum workpieces. The addition of 32 gm/l of 50% sodium hydroxide to the dispersion gave a cleaning solution for steel having a pH-value of 11.5.

EXAMPLE 5

A dispersion having the following composition was prepared.

11% of borax ($Na_2B_4O_7.5H_2O$),
6% of the adduct of 12 mols of ethylene oxide onto fatty alcohol,
3% of ethylene oxide/propylene oxide block polymer, and
80% of orthophosphoric acid (85%).

The borax and the surfactants were stirred into the orthophosphoric acid heated to 70° C. To prepare a cleaning solution having a pH-value of 11.5, 20 gm/l of dispersion and 30 gm/l of 50% sodium hydroxide were required.

EXAMPLE 6

A dispersion having the following composition was prepared:

10.0% of boric acid,
87.8% of orthophosphoric acid (85%),
1.0% of the adduct of 12 mols of ethylene oxide onto coconut oil fatty amine,
1.0% of nonionic wetting agent (adduct of 4 mols of ethylene oxide and 5 mols of propylene oxide onto fatty alcohol), and
0.2% of polyvinyl pyrrolidone.

To prepare a cleaning solution having a pH-value of 11.0, 20 gm/l of the dispersion required 32 gm/l of 50% sodium hydroxide.

In the examples above, and as is in accordance with the invention, each quantity of strongly alkaline active-substance concentrate or acidic active-substance concentrate is prepared separately. Then, the respective quantities of each concentrate are added separately to a base aqueous solution, preferably water or water with conventional additives. In this way, potential solubility difficulties are overcome.

The weight ratios of the concentrates to the final cleaning compositions can vary over a wide range. The ratio of the strongly alkaline active-substance concentrate (gm/l) to the final cleaning solution (gm/l) can range from about 0.5:1 to 5:1, preferably from about 0.7 to 3.5:1 and most preferably from about 1:1 to 3:1. The ratio of the acidic active-substance concentrate (gm/l) to the final cleaning solution (gm/l) can range from about 0.6:1 to 4:1, preferably from about 0.8:1 to 3:1 and most preferably from about 1:1 to 2:1.

The preceeding specific embodiments are illustrative of the practice of the invention. It is to be understood, however, that other expedients known to those skilled in the art or disclosed herein may be employed without departing from the spirit of the invention or the scope of the appended claims.

We claim:

1. An aqueous two-component cleaning composition comprising, as one component, (a) a strongly alkaline active-substance concentrate and, as the other component, (b) an acidic active-substance concentrate comprising a dispersion of boric acid or alkali metal borate in orthophosphoric acid in a ratio by weight of from about 1:4 to 1:20, component (a) being present in an excess sufficient to cause an alkaline medium when components (a) and (b) are combined.

2. The composition of claim 1, wherein component (b) contains sulfuric acid in place of up to one-half of the orthophosphoric acid.

3. The composition of claim 1, wherein component (b) also contains an effective amount of one or more complexing agents.

4. The composition of claim 3, wherein the complexing agents are selected from the group consisting of phosphonic acids and phosphonocarboxylic acids.

5. The composition of claim 1, wherein component (b) also contains an effective amount of one or more anionic, nonionic, or amphoteric surfactants.

6. The composition of claim 1, wherein component (b) also contains an effective amount of one or more stabilizers.

7. The composition of claim 1 which comprises (a) an aqueous sodium and/or potassium hydroxide solution and (b) a dispersion of boric acid or alkali metal borate in orthophosphoric acid in a weight ratio of from about 1:4 to 1:20 component (a) being present in an amount sufficient to cause the pH of the composition to be at least about 8 when components (a) and (b) are combined.

8. The composition of claim 7 where the pH of the composition is in the range of from 9 to 12 when components (a) and (b) are combined.

9. A process of preparing an aqueous cleaning composition from the components of claim 1 which comprises adding first one of components (a) and (b) and then the other of components (a) and (b) to water or a substantially aqueous bath.

* * * * *